US012595931B2

(12) United States Patent
Zhou et al.

(10) Patent No.: US 12,595,931 B2
(45) Date of Patent: Apr. 7, 2026

(54) FLOWGUIDE GRILLE, AIR CONDITIONER AND ENERGY STORAGE DEVICE

(71) Applicant: Sungrow Power Supply Co., Ltd., Hefei (CN)

(72) Inventors: Yingjie Zhou, Hefei (CN); Weilong Zhang, Hefei (CN); Youjin Yang, Hefei (CN); Shili Zhang, Hefei (CN); Youshun Bai, Hefei (CN)

(73) Assignee: Sungrow Power Supply Co., Ltd., Hefei (CN)

( * ) Notice: Subject to any disclaimer, the term of this patent is extended or adjusted under 35 U.S.C. 154(b) by 449 days.

(21) Appl. No.: 18/169,938

(22) Filed: Feb. 16, 2023

(65) Prior Publication Data

US 2023/0288094 A1 Sep. 14, 2023

(30) Foreign Application Priority Data

Mar. 14, 2022 (CN) ..... 202220566391.3

(51) Int. Cl.
*F24F 13/08* (2006.01)
*F24F 13/20* (2006.01)

(52) U.S. Cl.
CPC ..... *F24F 13/084* (2013.01); *F24F 13/20* (2013.01)

(58) Field of Classification Search
CPC ..... F24F 13/084; F24F 13/20; F24F 1/0325; F24F 13/08; F24F 13/18; F24F 13/075
USPC ..... 454/284
See application file for complete search history.

(56) References Cited

U.S. PATENT DOCUMENTS

2008/0207112 A1 8/2008 Michieli
2018/0209635 A1* 7/2018 Luiten ..... F21V 29/713
2025/0015382 A1* 1/2025 Zhou ..... H01M 10/48

FOREIGN PATENT DOCUMENTS

CN 101960663 A * 1/2011 ..... H01M 10/6566
CN 211350908 U 8/2020
CN 211830557 U 10/2020
CN 212366085 U 1/2021
CN 113241495 A 8/2021
CN 113692176 A 11/2021
(Continued)

OTHER PUBLICATIONS

Chung, Chae-ho, CN101960663 Translation.pdf, "Z type battery pack for vehicle", Jul. 2013, pp. 1-20.*
(Continued)

*Primary Examiner* — Avinash A Savani
*Assistant Examiner* — Ryan L Faulkner
(74) *Attorney, Agent, or Firm* — Wolf, Greenfield & Sacks, P.C.

(57) ABSTRACT

A flowguide grille, an air conditioner and an energy storage device are disclosed according to the present disclosure, the flowguide grille comprises a mounting bracket and a plurality of guide vanes, the mounting bracket is mounted on the air conditioner and covers an air outlet of the air conditioner, the mounting bracket is extended along an up-down direction of the air conditioner; the plurality of guide vanes are connected to the mounting bracket at intervals, the guide vane comprises a drainage plate and a guide plate, the drainage plate is extended along an air outlet direction of the air conditioner, and is bent upwards to be connected with the guide plate, the guide vanes are used for expanding the air outlet range of the air conditioner in the up-down direction.

15 Claims, 9 Drawing Sheets

(56) References Cited

FOREIGN PATENT DOCUMENTS

| | | | | | |
|---|---|---|---|---|---|
| CN | 215336996 | U | | 12/2021 | |
| CN | 115540086 | A | * | 12/2022 | ..... F24F 1/24 |
| EP | 1 965 142 | A2 | | 9/2008 | |
| JP | 2002-058117 | A | | 2/2002 | |
| JP | 2014-173773 | A | | 9/2014 | |

OTHER PUBLICATIONS

Sun, Wei, CN115540086 Translation.pdf, "Heat dissipation structure and air conditioner outdoor unit", Dec. 2022, pp. 1-18.*
Extended European Search Report dated Aug. 7, 2023, in connection with European Application No. 23156421.2-1108.

* cited by examiner

FLOWGUIDE GRILLE, AIR CONDITIONER AND ENERGY STORAGE DEVICE

CROSS REFERENCE OF RELATED APPLICATION

The present application claims priority to Chinese Patent Application No. 202220566391.3, titled "FLOWGUIDE GRILLE, AIR CONDITIONER AND ENERGY STORAGE DEVICE", filed on Mar. 14, 2022 with the China National Intellectual Property Administration, which is incorporated herein by reference in its entirety.

FIELD

The present disclosure relates to the technical field of heat dissipation equipment, and in particular to a flowguide grille, an air conditioner and an energy storage device.

BACKGROUND

With the development of science and technology, most of the current energy storage devices are equipped with larger battery assemblies to meet the demand of high-power operation of external equipment. In order to reduce the heat generated by the battery assembly during long-term operation or high-power operation, the current energy storage devices usually provide air conditioners to dissipate heat from the battery assembly.

However, the air conditioner in the energy storage device is generally floor mounted, an air outlet height of the air conditioner is lower than the height of the battery assembly, so that the cold air of the air conditioner acting in the height direction of the battery assembly is unevenly distributed, the part of the battery assembly with great height has insufficient heat dissipation, so that the temperature difference of a battery cell in a height direction of the battery assembly is huge, which affects the good operation of the energy storage device.

SUMMARY

The present disclosure is directed to provide a flowguide grille, which aims to increase an air outlet range of an air conditioner in a height direction and make the air outlet of the air conditioner more uniform.

In order to achieve the above object, the flowguide grille and an air conditioner mounted in an energy storage device are provided according to the present disclosure, it is defined that the air conditioner has an up-down direction, the flowguide grille includes a mounting bracket and multiple guide vanes, the mounting bracket is mounted on the air conditioner and covers an air outlet of the air conditioner, the mounting bracket is extended along a vertical direction of the air conditioner; multiple guide vanes are connected to the mounting bracket at intervals, the guide vane includes a drainage plate and a guide plate, the drainage plate is extended along an air outlet direction of the air conditioner, and is bent upwards to be connected with the guide plate. The guide vanes are used for expanding the air outlet range of the air conditioner in the up-down direction.

In an embodiment, it is defined that an angle between a plate surface of the drainage plate and a plate surface of the guide plate is $\alpha$, which satisfies the relation: $135 \leq \alpha \leq 150$.

In an embodiment, the mounting bracket includes two oppositely arranged mounting rods, the two mounting rods are mounted on the air conditioner and are arranged around the air outlet of the air conditioner. It is defined that both the drainage plate and the guide plate have two opposite side surfaces, the two side surfaces of the drainage plate are respectively connected to the two mounting rods, the two side surfaces of the guide plate are respectively at least partially connected to the two mounting rods.

In an embodiment, a distance between any two adjacent guide vanes is defined as H, which satisfies the relation: 60 mm≤H≤100 mm.

In an embodiment, a length of the guide vane is defined as L, which satisfies the relation: 500 mm≤L≤1500 mm.

In an embodiment, multiple guide vanes are formed with a high wind level component and a low wind level component, the high wind level component is located above the low wind level component. The length of the guide vane of the high wind level component is defined as L1, and the length of the guide vane of the low wind level component is defined as L2, which satisfies the relation: L1>L2, and 500 mm≤L1≤1500 mm, 500 mm≤L2≤1500 mm.

In an embodiment, the guide plate includes a first plate section and a second plate section, the first plate section is connected to the drainage plate, and the first plate section is extended upward and is bent to be connected with the second plate section.

In an embodiment, a shape of the first plate section is arc. And/or, the second plate section is extended in a horizontal direction. And/or, the guide plate and the drainage plate are in an integrated structure.

An air conditioner is further provided according to the present disclosure, including a machine body and a flowguide grille, the flowguide grille is mounted on the machine body and covers an air outlet of the machine body. The flowguide grille includes a mounting bracket and multiple guide vanes, the mounting bracket is mounted on the air conditioner and covers the air outlet of the air conditioner, the mounting bracket is extended along a vertical direction of the air conditioner; the multiple guide vanes are connected to the mounting bracket at intervals, the guide vane includes a drainage plate and a guide plate, the drainage plate is extended along the air outlet direction of the air conditioner, and is bent upwards to be connected with the guide plate, the guide vanes are used for expanding the air outlet range of the air conditioner in the up-down direction.

An energy storage device is further provided according to the present disclosure, including a box body, a battery assembly and an air conditioner, the air conditioner and the battery assembly are mounted in the box body, the air conditioner is arranged at one side of the battery assembly. The air conditioner includes a machine body and a flowguide grille, the flowguide grille is mounted on the machine body and covers an air outlet of the machine body. The flowguide grille includes a mounting bracket and multiple guide vanes, the mounting bracket is mounted on the air conditioner and covers the air outlet of the air conditioner, the mounting bracket is extended along a vertical direction of the air conditioner; the multiple guide vanes are connected to the mounting bracket at intervals, the guide vane includes a drainage plate and a guide plate, the drainage plate is extended along the air outlet direction of the air conditioner, and is bent upwards to be connected with the guide plate, the guide vanes are used for expanding the air outlet range of the air conditioner in the up-down direction.

According to the technical solution of the present disclosure, the air outlet angle of the air conditioner is adjusted by the guide vanes, thereby expanding the air outlet range of the air conditioner in the up-down direction. The drainage plate is extended along the air outlet direction of the air conditioner and is bent upwards to be connected with the guide plate, so that the guide plate can be extended upwards, so that the cold air blown out by the air conditioner can flow to a higher place under the guidance of the guide plate, so that the air conditioner can dissipate heat at a position higher than the air outlet, thereby effectively expanding the air outlet range of the air conditioner, improving the heat dissipation effect of the air conditioner and meeting the requirements of users. Meanwhile, by covering the air outlet of the air conditioner with multiple guide vanes at intervals, the cold air blown by the air conditioner can be evenly distributed on each layer of guide vanes, so that the air supply of the air conditioner can be more uniform, and the practicability and reliability of the flowguide grille are effectively improved.

BRIEF DESCRIPTION OF THE DRAWINGS

For more clearly illustrating embodiments of the present disclosure or the technical solutions in the conventional technology, drawings referred to describe the embodiments or the conventional technology will be briefly described hereinafter. Apparently, the drawings in the following description are only some examples of the present disclosure, and for those skilled in the art, other drawings may be obtained based on these drawings without any creative efforts.

Figure 1:
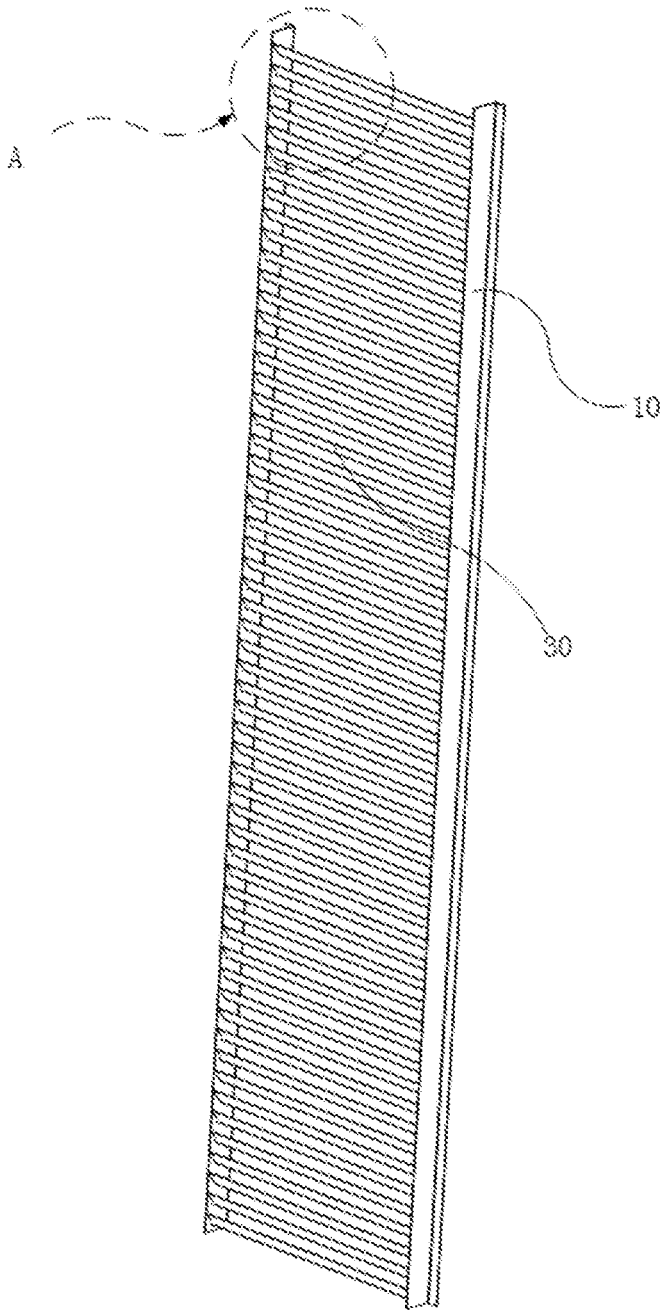
FIG. 1 is a three-dimensional structural diagram of an embodiment of a flowguide grille of the present disclosure.

Reference numerals in the drawings are as follows:

| Reference numerals | name | Reference numerals | name |
|---|---|---|---|
| 100 | Flowguide grille | 331 | First plate section |
| 10 | Mounting bracket | 333 | Second plate section |
| 11 | Mounting rod | 200 | Machine body |
| 30 | Guide vane | 20 | Air outlet |
| 30a | High wind level component | 300 | Air conditioner |
| 30b | Low wind level component | 400 | Battery assembly |
| 31 | Drainage plate | 500 | Box body |
| 33 | Guide plate | 600 | Energy storage device |

The realization of the objects, functional characteristics and advantages of the present disclosure will be further described in conjunction with the embodiments and with reference to the drawings.

DETAILED DESCRIPTION OF THE EMBODIMENTS

The technical solutions according to the embodiments of the present disclosure will be described clearly and completely as follows in conjunction with the drawings in the embodiments of the present disclosure. It is apparent that the described embodiments are only a part of the embodiments according to the present disclosure, rather than all of the embodiments. Based on the embodiments of the present disclosure, all other embodiments obtained by those having ordinary skill in the art without creative work shall fall within the protection scope of the present disclosure.

It should be noted that, all directional terms (such as top, bottom, left, right, front, back, etc.) in embodiments of the present disclosure are only intended to illustrate a relative position relation, relative motion, or the like between different components under a particular attitude (as shown in the drawings). The directional terms may change in case of a different attitude.

In the present disclosure, unless otherwise specified and limited, the terms "connected" and "fixed" should be understood broadly. For example, "fixed" can be a fixed connection, a detachable connection, or integrated; a mechanical connection or an electrical connection; a direct connection, an indirect connection through an intermediate medium, or an internal communication between two components, or the interaction between two components, unless otherwise explicitly defined. For those skilled in the art, the specific meaning of the above terms in the present disclosure may be understood in the light of specific circumstances.

In addition, the descriptions of "first" and "second" in the present disclosure are only used for descriptive purposes, and cannot be understood as indicating or implying their relative importance, or implicitly indicating the number of indicated technical features. Therefore, the features defined with "first" and "second" can include at least one of the features explicitly or implicitly. In addition, the meaning of "and/or" appearing in the whole specification means that it includes three parallel solutions, Take "A and/or B" as an example, including plan A, or plan B, or the plan A and B meet at the same time. In addition, the technical solutions between the various embodiments can be combined with each other, but they must be based on the realization by a person skilled in the art. When the combination of technical solutions is contradictory or cannot be realized, it should be considered that such a combination of technical solutions does not exist, and is not within the protection scope of the present disclosure.

The air conditioner 300 in the energy storage device 600 is generally floor mounted, an air outlet height of the air conditioner 300 is lower than the height of the battery assembly 400, so that the cold air of the air conditioner 300 acting in the height direction of the battery assembly 400 is unevenly distributed, the part of the battery assembly 400 with high height has insufficient heat dissipation effort, so that the temperature difference of a battery cell in a height direction of the battery assembly 400 is huge, which affects the good operation of the energy storage device 600. In view of the above problems, a flowguide grille 100 is provided according to the present disclosure.

Referring to FIG. 1 to FIG. 9, in the embodiment of the present disclosure, the flowguide grille 100 is mounted in the air conditioner 300 of the energy storage device 600, it is defined that the air conditioner 300 has an up-down direction. The flowguide grille 100 includes a mounting bracket 10 and multiple guide vanes 30, the mounting bracket 10 is mounted on the air conditioner 300 and covers the air outlet 20 of the air conditioner 300, the mounting bracket 10 is extended along the up-down direction of the air conditioner 300; the multiple guide vanes 30 are connected to the mounting bracket 10 at intervals, the guide vane 30 includes a drainage plate 31 and a guide plate 33, the drainage plate 31 is extended along the air outlet direction of the air conditioner 300, and is bent upwards to be connected with the guide plate 33, the guide vanes 30 are used for expanding the air outlet range of the air conditioner 300 in the up-down direction.

According to the technical solution of the present disclosure, the air outlet angle of the air conditioner 300 is adjusted by the guide vanes 30, thereby expanding the air outlet range of the air conditioner 300 in the up-down direction. The drainage plate 31 is extended along the air outlet direction of the air conditioner 300 and is bent upwards to be connected with the guide plate 33, so that the guide plate 33 can be extended upwards, so that the cold air blown out by the air conditioner 300 can flow to a higher place under the guidance of the guide plate 33, so that the air conditioner 300 can dissipate heat at a position higher than the air outlet 20, thereby effectively expanding the air outlet range of the air conditioner 300, improving the heat dissipation effect of the air conditioner 300 and meeting the requirements of users. Meanwhile, by covering the air outlet 20 of the air conditioner 300 with multiple guide vanes 30 at intervals, the cold air blown by the air conditioner 300 can be evenly distributed on each layer of guide vanes 30, so that the air supply of the air conditioner 300 can be more uniform, and the practicability and reliability of the flowguide grille 100 are effectively improved.

It can be understood that, besides the guiding effect by the guide plate 33, the drainage plate 31 can lengthen the horizontal air outlet distance of the air conditioner 300, and thus the cold air blown by the air conditioner 300 can be closer to the equipment (such as batteries) to be cooled in the energy storage device 600, so that cold air can be better concentrated on the equipment for heat dissipation, and the heat dissipation effect and efficiency are effectively improved.

Figure 2:
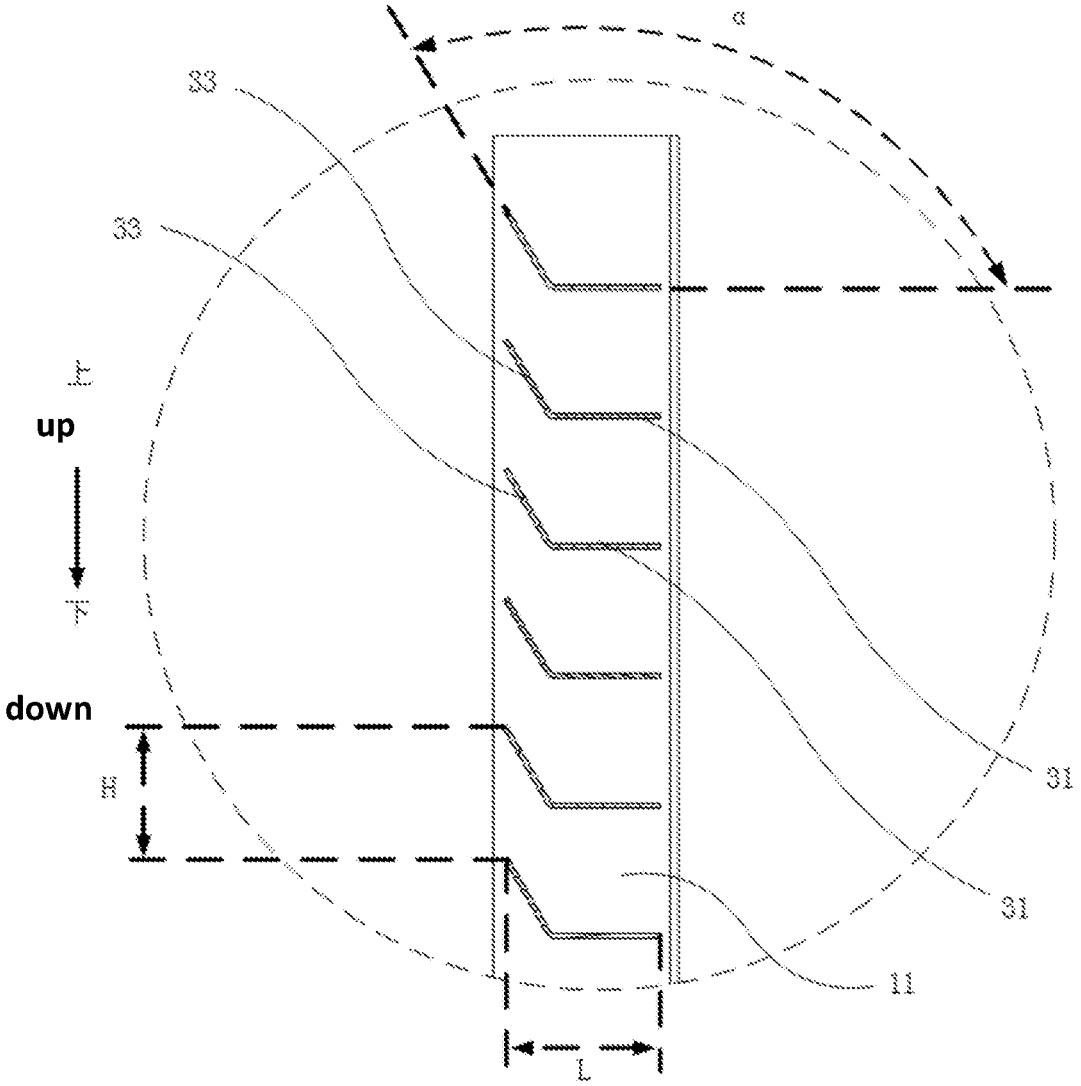
FIG. 2 is a partial sectional view at a in FIG. 1.
Figure 5:
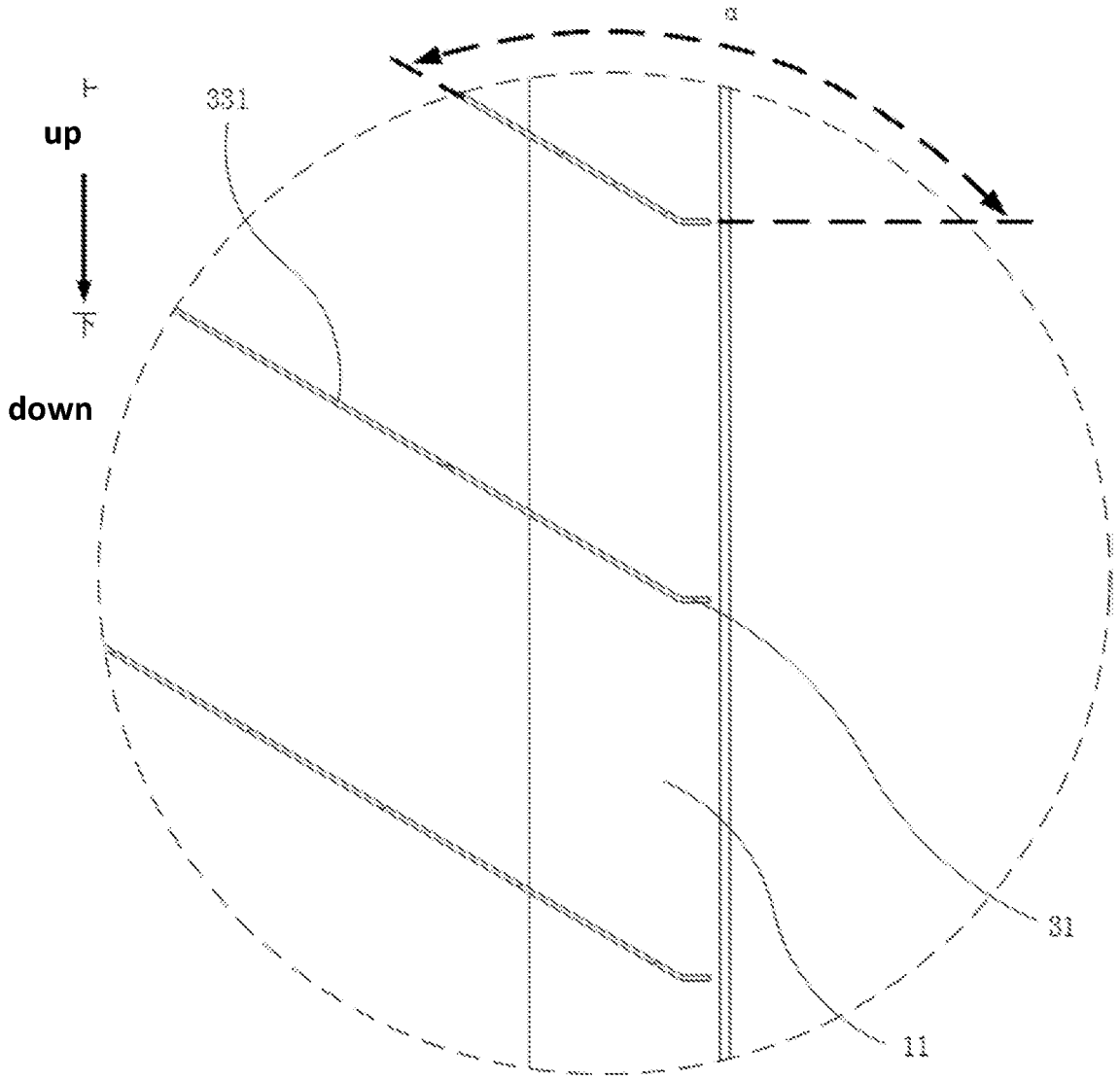
FIG. 5 is a partial enlarged view of portion B in FIG. 4.

Referring to FIG. 2 and FIG. 5, in an embodiment of the present disclosure, it is defined that an angle between a plate surface of the drainage plate 31 and a plate surface of the guide plate 33 is $\alpha$, which satisfies the relation: 135 degree$\leq\alpha\leq$150 degree.

It can be understood that the bending angle of the drainage plate 31 can affect the guide function of the guide plate 33, the angle between the plate surface of the drainage plate 31 and the plate surface of the guide plate 33 determines the bending angle of the drainage plate 31, and in order to ensure that the guide vanes 30 can better guide the cold air upward, it can be defined that the angle $\alpha$ between the plate surface of the drainage plate 31 and the plate surface of the guide plate 33 is between 135 degree and 150 degree. When $\alpha\leq$150 degree, as the angle decreases, the degree of upward inclination of the guide plate 33 is higher, so that the guide plate 33 can better guide the cold air blown by the air conditioner 300 upward, and as the angle decreases, the length of the guide plate 33 can gradually decrease with the same guiding height, which is beneficial to reduce the climbing distance of cold air, reduce the loss of wind energy and further improve the heat dissipation efficiency. If the angle $\alpha$ is too small, the degree of upward inclination of the guide plate 33 can be too large, the stronger the blocking effect of guide plate 33 on cold air, the greater the loss of wind energy can be, and the heat dissipation effect is affected with some probability. Therefore, a should also satisfy $\alpha\geq$135 degree, in which the inclination degree of the guide plate 33 is low, which is beneficial to reduce the resistance of the guide plate 33 to the cold air, so that the energy consumption of the cold air guided by the guide plate 33 is less, and it is beneficial to improve the heat dissipation effect of the cold air.

Secondly, in order to further reduce the resistance of cold air by the guide vanes 30, the bend of the drainage plate 31 can be arc-shaped, so that cold air can flow upward along the arc when flowing from the drainage plate 31 to the guide plate 33, which effectively reduces the resistance of the cold air at the bend, reduces the energy consumption of the cold air flowing in the guide vane 30, and further improves the heat dissipation efficiency.

Figure 3:
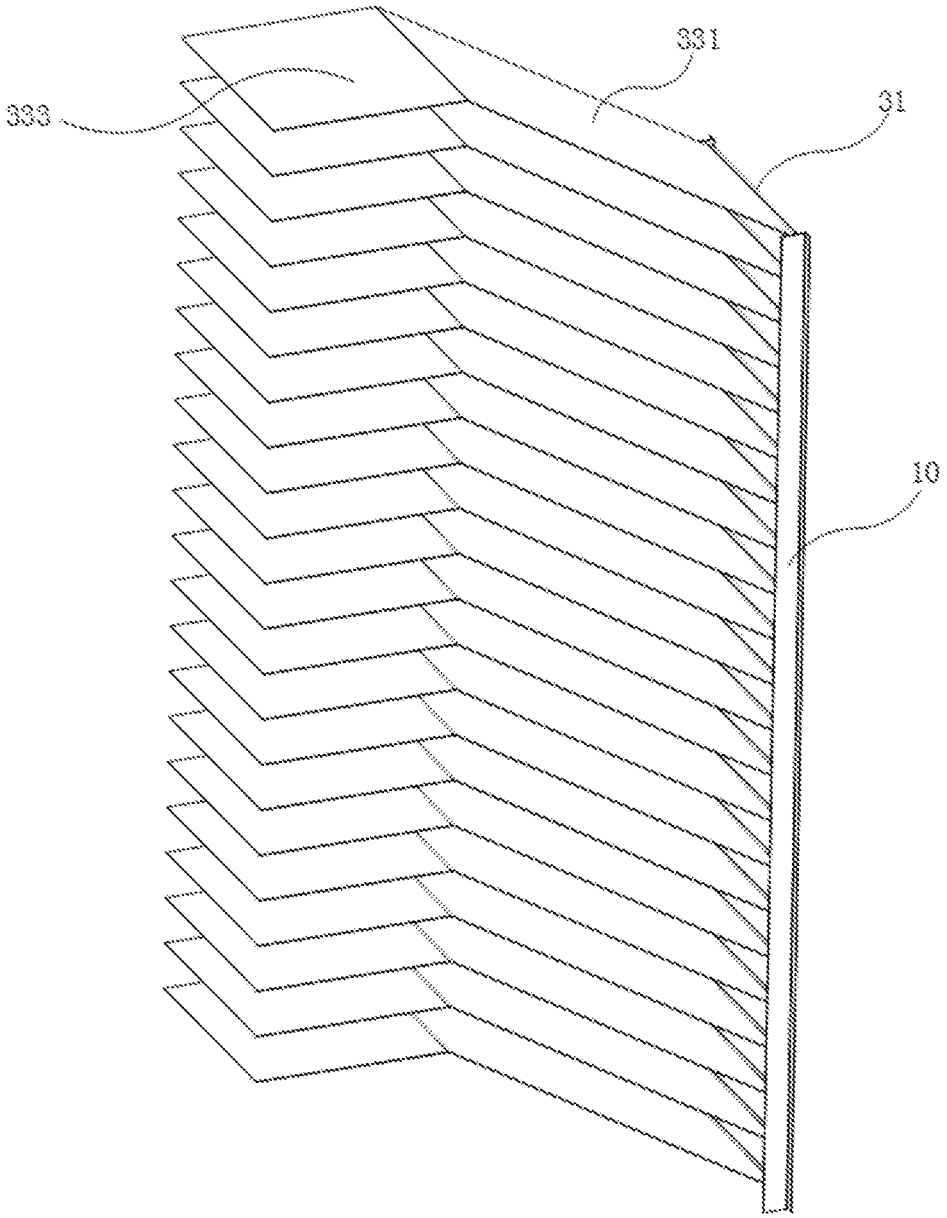
FIG. 3 is a three-dimensional structure diagram of another embodiment of the flowguide grille of the present disclosure.
Figure 6:
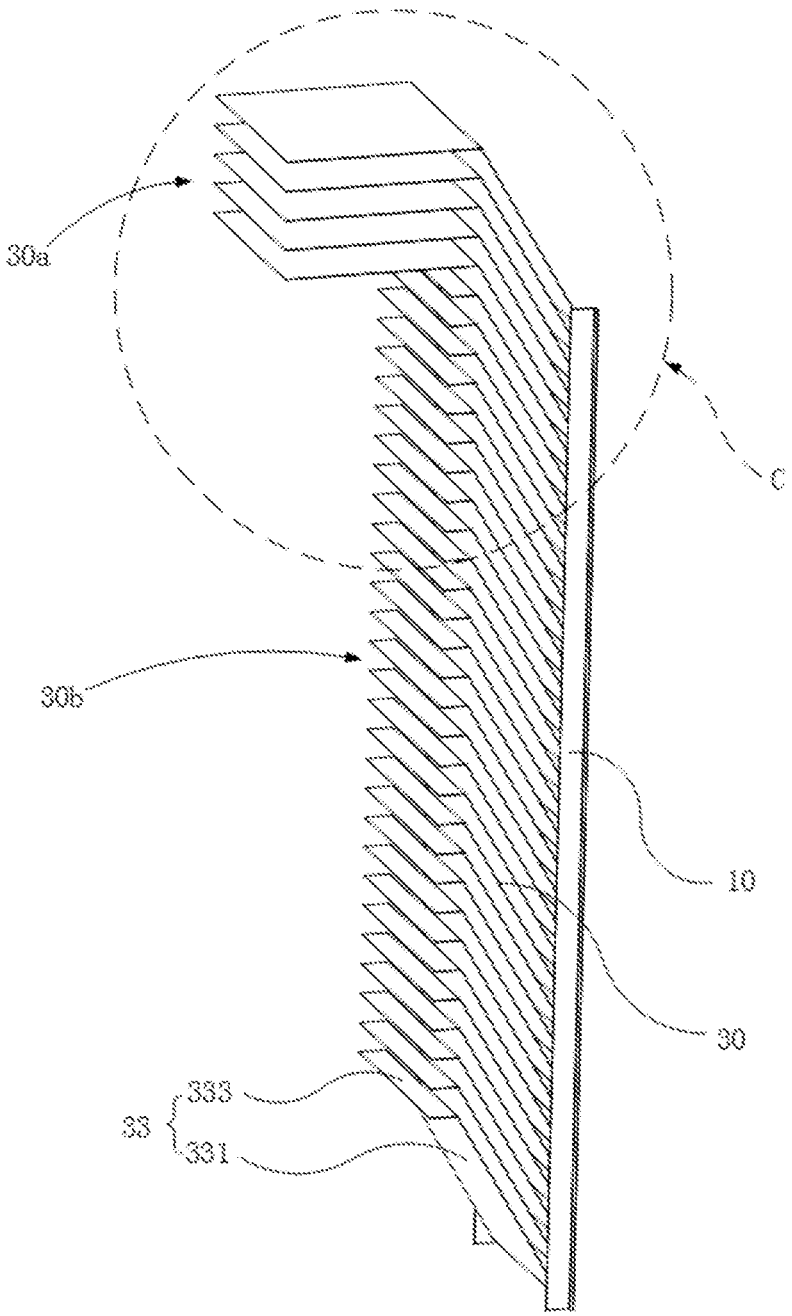
FIG. 6 is a three-dimensional structure diagram of another embodiment of the flowguide grille of the present disclosure.

Referring to FIG. 1, FIG. 3 and FIG. 6, in an embodiment of the present disclosure, the mounting bracket 10 includes two oppositely arranged mounting rods 11, the two mounting rods 11 are mounted on the air conditioner 300 and are arranged around the air outlet 20 of the air conditioner 300. It is defined that both the drainage plate 31 and the guide plate 33 have two opposite side surfaces, the two side surfaces of the drainage plate 31 are respectively connected to the two mounting rods 11, and the two side surfaces of the guide plate 33 are respectively at least partially connected to the two mounting rods 11.

In this embodiment, the air conditioner 300 is connected by two relatively arranged mounting rods 11, which can effectively reduce the occupied area of the flowguide grille 100 on the air conditioner 300. It can be understood that the mounting rod 11 can be fixed on the air conditioner 300 by screw connection or by welding, so that the mounting rod 11 can be firmly connected to the air conditioner 300, and the mounting bracket 10 can provide better support for the guide vane 30. The two side surfaces of the drainage plate 31 and the two side surfaces of the guide plate 33 can be connected to the mounting rod 11, the mounting rod 11 can be enclosed with the guide vanes 30 to form multiple air outlet channels, and the cold air blown by the air conditioner 300 can act on the equipment more intensively under the action of the flowguide grille 100. It is also possible to connect two side surfaces of the drainage plate 31 to the mounting rod 11, and connect part of two side surface portions of the guide plate 33 to the mounting rod 11, so that cold air can be concentrated to flow to the guide plate 33 through the drainage plate 31, and then dispersedly acts on the energy storage device 600 in the process of flowing upward along the guide plate 33, the cold wind can be more evenly distributed in the energy storage device 600 while blowing to a higher place, thus meeting a wider range of heat dissipation requirements.

Figure 4:
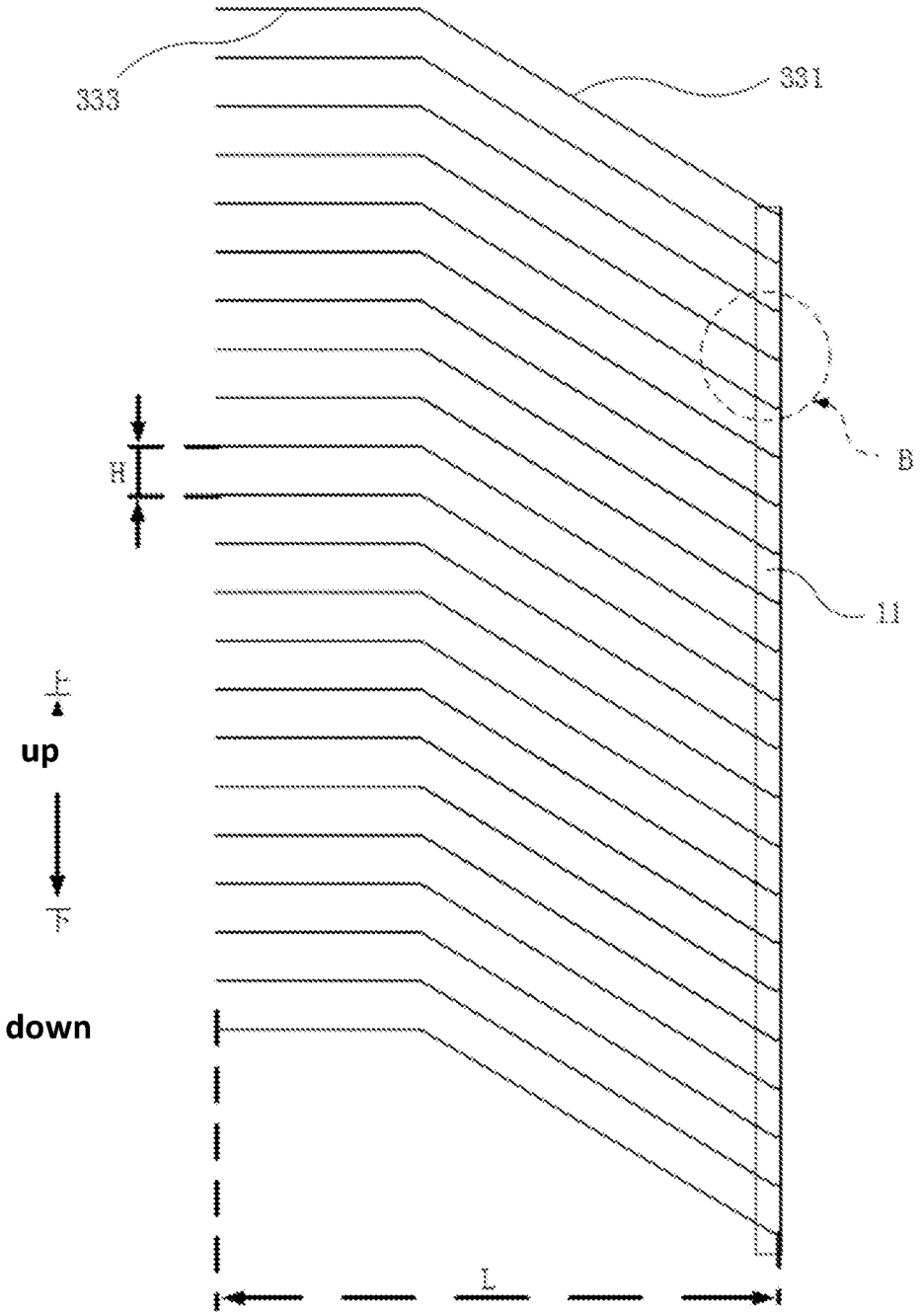
FIG. 4 is a cross-sectional view of an embodiment of the flowguide grille of FIG. 3.
Figure 7:
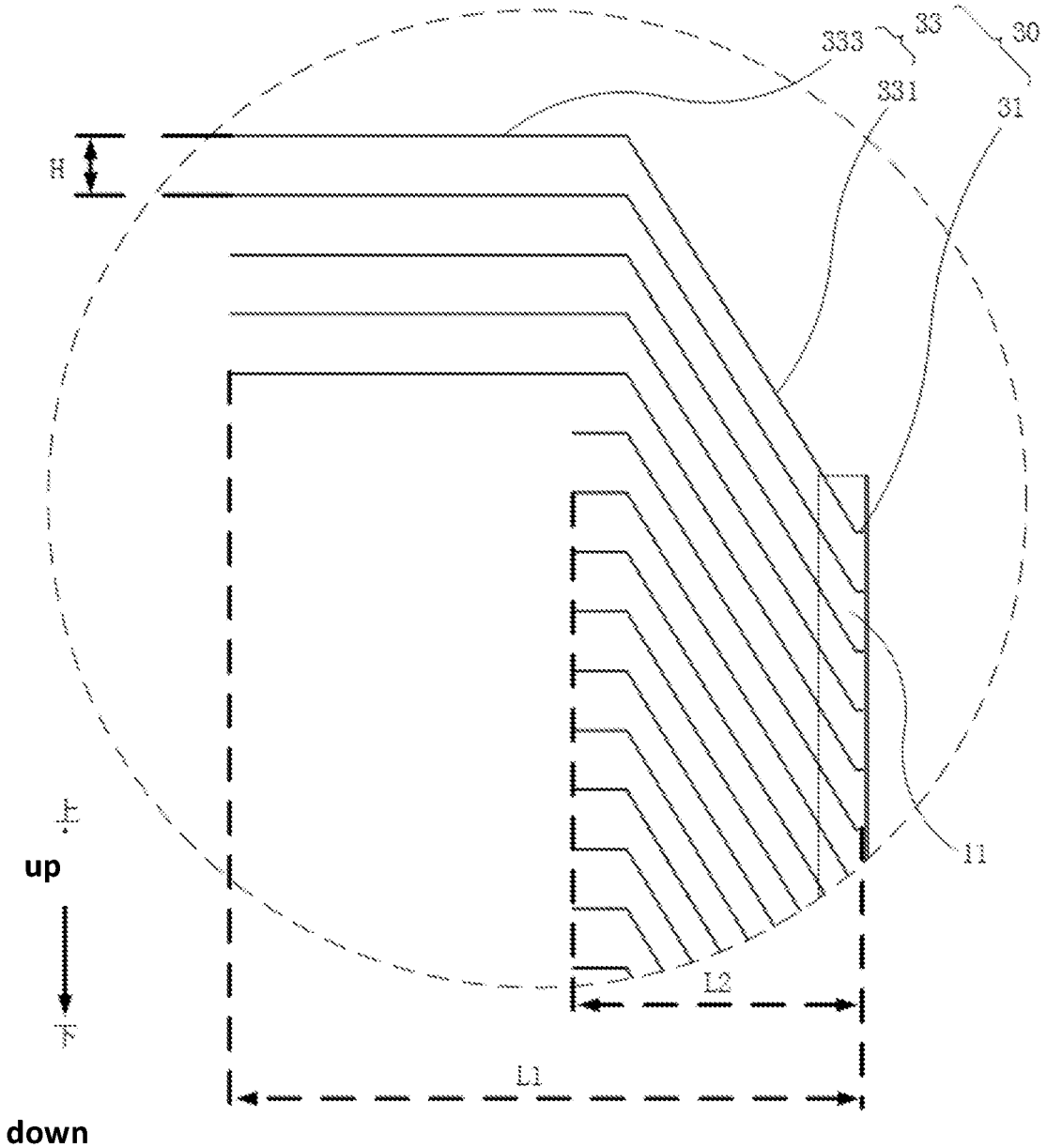
FIG. 7 is a partial cross-sectional view at C in FIG. 6.
Figure 8:
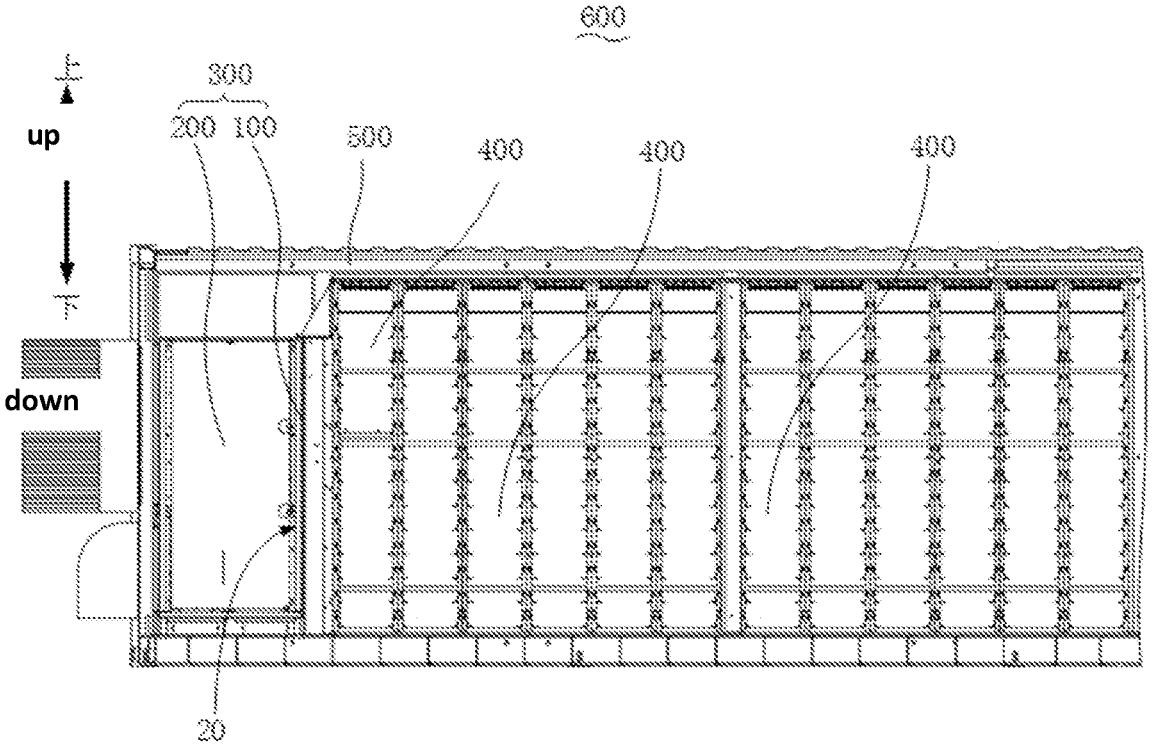
FIG. 8 is a front view of an internal structure of an embodiment of an energy storage device of the present disclosure.
Figure 9:
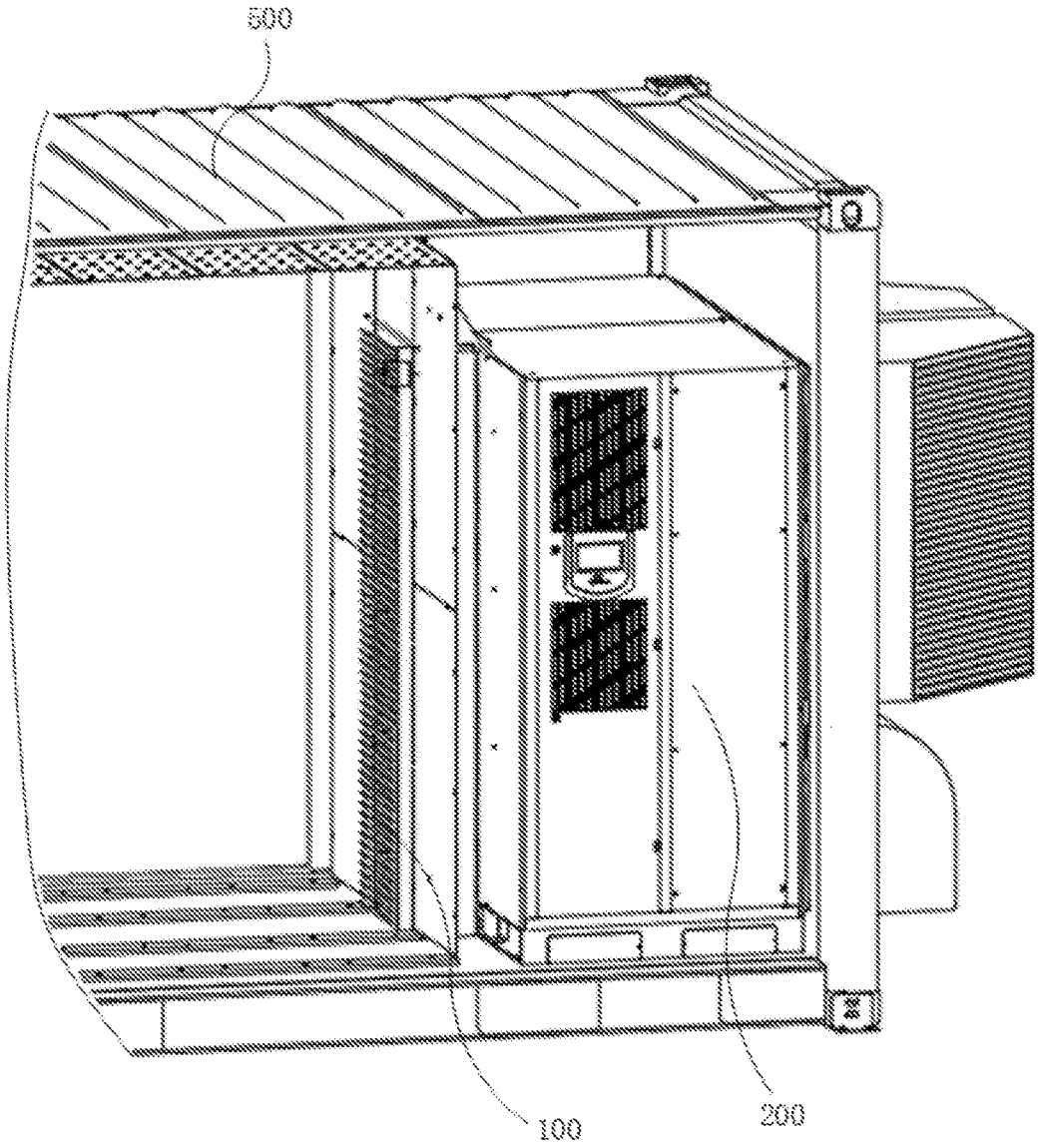
FIG. 9 is a partial three-dimensional view of an embodiment of the energy storage device of FIG. 8.

Referring to FIG. 2, FIG. 4 and FIG. 7, in an embodiment of the present disclosure, the distance between any two adjacent guide vanes 30 is defined as H, which satisfies the relation: 60 mm$\leq$H$\leq$100 mm.

To ensure that the cold air blown by the air conditioner 300 can better act on the equipment, it is necessary to ensure a certain distance between any two adjacent guide vanes 30. When H$\geq$60 mm, the resistance of the cold air between the two guide vanes 30 can be gradually reduced as the increase of the distance, and the energy consumption of the cold air can be reduced, and the air volume blown between any two adjacent guide vanes 30 can be increased, so that the air volume distribution along the vertical direction of the flowguide grille 100 is more uniform and the heat dissipation effect is better. When H$\leq$100 mm, the distance between the two guide vanes 30 is not too large, so that air can be completely discharged between any two guide vanes 30, and cold air can be more intensively guided to a higher place by the guide vanes 30, avoiding that: if the distance between the guide vanes 30 is too large, there is a certain probability that the air cannot be completely discharged between any two guide vanes 30, which may affect the uniform air outlet of the flowguide grille 100.

Referring to the figure, in an embodiment of the present disclosure, a length of the guide vane 30 is defined as L, which satisfies the relation: 500 mm≤L≤1500 mm.

In the energy storage device 600, there is a certain air outlet distance between the air conditioner 300 and the equipment, when L≥500 mm, as the increase of the length of the guide vane 30, the air outlet distance can gradually decrease, which is beneficial for the flowguide grille 100 to concentrate the cold air on the equipment as much as possible for heat dissipation, and further improve the heat dissipation efficiency and effect. When L≤1500 mm, excessive length of guide vane 30 can be avoided, thus avoiding excessive volume and weight of guide vane 30, so that the mounting bracket 10 can better support the guide vanes 30, which is beneficial for the layout design of the air conditioner 300 and equipment, and when the length of the guide vanes 30 is within this range, the energy consumption of cold air passing through the flowguide grille 100 is low, so that the cold air blown by the air conditioner 300 can act on the equipment better and more intensively, and further improve the heat dissipation efficiency and effect.

Referring to FIG. 6 and FIG. 7, in an embodiment of the present disclosure, multiple guide vanes 30 are formed with a high wind level component 30*a* and a low wind level component 30*b*, the high wind level component 30*a* is located above the low wind level component 30*b*. The length of the guide vane 30 of the high wind level component 30*a* is defined as L1, and the length of the guide vane 30 of the low wind level component 30*b* is defined as L2, which satisfies the relation: L1>L2, and 500 mm≤L1≤1500 mm, 500 mm≤L2≤1500 mm.

It can be understood that the longer high wind level component 30*a* can better guide the cold air blown by the air conditioner 300 to the higher-level equipment, so as to avoid that the cold air is condensed at the lower position of the energy storage device 600 in a certain probability due to gravity, so that the equipment at the higher position cannot be heat dissipated, which may affect the overall heat dissipation effect of the energy storage device 600. However, due to the gravity, more cold air is condensed in the lower area of the energy storage device 600, and the heat dissipation effect is better. Therefore, in order to reduce the volume and weight of the flowguide grille 100, the length of the guide vanes 30 of the low wind level component 30*b* can be appropriately reduced, so that the length of the guide vane 30 of the low wind level component 30*b* is less than the length of the guide vane 30 of the high wind level component 30*a*, and the volume and weight of the flowguide grille 100 can be reduced while ensuring the guide effect of the flowguide grille 100, which is beneficial for the portable design of the flowguide grille 100.

Referring to FIG. 3, FIG. 4, FIG. 6 and FIG. 7, in an embodiment of the present disclosure, the guide plate 33 includes a first plate section 331 and a second plate section 333, the first plate section 331 is connected to the drainage plate 31, the first plate section 331 is extended upward and is bent to be connected with the second plate section 333.

It can be understood that, the first plate section 331 is bent to be connected with the second plate section 333, so that the cold air is guided upward to a higher position by the first plate section 331, and then smoothly flow along the horizontal direction under the guidance of the second plate section 333, and the cold air can directly act on the equipment along the horizontal direction, thus achieving a better heat dissipation effect and effectively improving the heat dissipation efficiency.

Secondly, in order to further reduce the resistance of cold air by the guide vanes 30, the bend of the first plate section 331 can be arc-shaped, so that cold air can flow along an arc when flowing from the first plate section 331 to the second plate section 333, which effectively reduces the resistance of the cold air at the bend, reduces the energy consumption of the cold air flowing in the guide vane 30, and further improves the heat dissipation efficiency.

Further, in an embodiment of the present disclosure, the shape of the first plate section 331 is arc. And/or, the second plate section 333 is extended in a horizontal direction. And/or, the guide plate 33 and the drainage plate 31 are in an integrated structure.

It can be understood that, the arc-shaped structure of the first plate section 331 can reduce the resistance of the first plate section 331 to the cold air during flow guiding, so that the cold air can flow more smoothly upward, which reduces the energy consumption of cold air passing through the guide vanes 30 and improves the heat dissipation efficiency.

Secondly, the second plate section 333 is used to make the cold air flow out of the flowguide grille 100 in the horizontal direction and then blow the equipment directly, so as to achieve a better heat dissipation effect. Therefore, by extending the second plate section 333 along the horizontal direction, a better flow guiding effect can be achieved, and the resistance of the second plate section 333 to cold air can be reduced, which further reducing the energy consumption of cold air and improving the heat dissipation efficiency.

When the air conditioner 300 is in operation, the cold air from the air conditioner 300 exerts a large force on the guide vane 30, in order to further improve the structural stability of the flowguide grille 100, the guide vane 30 can be formed by integral injection molding or integral forging, so that the guide plate 33 and the drainage plate 31 are integrated, which effectively improves the structure strength of the guide vane 30, thereby making the structure of the flowguide grille 100 more stable.

An air conditioner 300 is further provided according to the present disclosure, the air conditioner 300 includes a machine body 200 and a flowguide grille 100, and the flowguide grille 100 is mounted on the machine body 200 and covers the air outlet 20 of the machine body 200. The specific structure of the flowguide grille 100 refers to the above-mentioned embodiments, and since the air conditioner 300 adopts all the technical solutions of all the above-mentioned embodiments, it has at least all the beneficial effects brought by the technical solutions of the above-mentioned embodiments, which are not repeated herein.

An energy storage device 600 is further provided according to the present disclosure, including a box body 500, a battery assembly 400 and an air conditioner 300, the air conditioner 300 and the battery assembly 400 are mounted in the box body 500, the air conditioner 300 is arranged at one side of the battery assembly 400. The specific structure of the air conditioner 300 refers to the above-mentioned embodiments, and since the energy storage device 600 adopts all the technical solutions of all the above-mentioned embodiments, it has at least all the beneficial effects brought by the technical solutions of the above-mentioned embodiments, which are not repeated herein.

The above are only preferred embodiments of the present disclosure, and do not limit the scope of the present disclosure. Under the concept of the present disclosure, any equivalent structural transformation made by using the content of description and drawings of the present disclosure, or direct/indirect disclosures in other related technical fields, are included in the protection scope of the present disclosure.

The invention claimed is:

1. A flowguide grille, which is mounted in an air conditioner of an energy storage device, the air conditioner having an up-down direction, wherein the flowguide grille comprises:

a mounting bracket, wherein the mounting bracket is mounted on the air conditioner and covers an air outlet of the air conditioner, the mounting bracket is extended along a vertical direction of the air conditioner; and a plurality of guide vanes, wherein the plurality of guide vanes are connected to the mounting bracket at intervals, the guide vane comprises a drainage plate and a guide plate, the drainage plate is extended along an air outlet direction of the air conditioner, and is bent upwards to be connected with the guide plate, the guide vanes are configured for expanding the air outlet range of the air conditioner in the up-down direction;

wherein a distance between any two adjacent guide vanes is defined as H, which satisfies the relation: 60 mm≤H≤100 mm;

wherein a length of the guide vane is defined as L, which satisfies the relation: 500 mm≤L≤1500 mm.

2. The flowguide grille according to claim 1, wherein an angle between a plate surface of the drainage plate and a plate surface of the guide plate is α, which satisfies the relation: 135 degree≤α≤150 degree.

3. The flowguide grille according to claim 1, wherein the mounting bracket comprises two oppositely arranged mounting rods, the two mounting rods are mounted on the air conditioner and are arranged around the air outlet of the air conditioner;

wherein both the drainage plate and the guide plate have two opposite side surfaces, the two side surfaces of the drainage plate are respectively connected to the two mounting rods, the two side surfaces of the guide plate are respectively at least partially connected to the two mounting rods.

4. The flowguide grille according to claim 1, wherein the plurality of guide vanes are formed with a high wind level component and a low wind level component, the high wind level component is located above the low wind level component;

wherein the length of the guide vane of the high wind level component is defined as L1, and the length of the guide vane of the low wind level component is defined as L2, which satisfies the relation: L1>L2, and 500 mm≤L1≤1500 mm, 500 mm≤L2≤1500 mm.

5. The flowguide grille according to claim 1, wherein the guide plate comprises a first plate section and a second plate section, the first plate section is connected to the drainage plate, and the first plate section is extended upward and is bent and connected with the second plate section.

6. The flowguide grille according to claim 5, wherein a shape of the first plate section is arc;

and/or, the second plate section is extended in a horizontal direction;

and/or, the guide plate and the drainage plate are in an integrated structure.

7. An air conditioner, comprising a machine body and a flowguide grille, wherein the flowguide grille is mounted on the machine body and covers an air outlet of the machine body, the air conditioner has an up-down direction, and the flowguide grille comprises:

a mounting bracket, wherein the mounting bracket is mounted on the air conditioner and covers the air outlet of the air conditioner, the mounting bracket is extended along a vertical direction of the air conditioner; and a plurality of guide vanes, wherein the plurality of guide vanes are connected to the mounting bracket at intervals, the guide vane comprises a drainage plate and a guide plate, the drainage plate is extended along an air outlet direction of the air conditioner, and is bent upwards to be connected with the guide plate, the guide vanes are configured for expanding the air outlet range of the air conditioner in the up-down direction;

wherein a distance between any two adjacent guide vanes is defined as H, which satisfies the relation: 60 mm≤H≤100 mm;

wherein a length of the guide vane is defined as L, which satisfies the relation: 500 mm≤L≤1500 mm.

8. An energy storage device, comprising a box body, a battery assembly and the air conditioner according to claim 7, wherein the air conditioner and the battery assembly are mounted in the box body, and the air conditioner is arranged at one side of the battery assembly.

9. A flowguide grille, which is mounted in an air conditioner of an energy storage device, the air conditioner having an up-down direction, wherein the flowguide grille comprises:

a mounting bracket, wherein the mounting bracket is extended along a vertical direction of the air conditioner; and a plurality of guide vanes, wherein the plurality of guide vanes are connected to the mounting bracket at intervals, the guide vane comprises a drainage plate and a guide plate, the drainage plate is extended along an air outlet direction of the air conditioner, and is bent upwards to be connected with the guide plate, the guide vanes are configured for expanding the air outlet range of the air conditioner in the up-down direction;

wherein the plurality of guide vanes are formed with a high wind level component and a low wind level component, the high wind level component is located above the low wind level component;

wherein the length of the guide vane of the high wind level component is defined as L1, and the length of the guide vane of the low wind level component is defined as L2, which satisfies the relation: L1>L2, and 500 mm≤L1≤1500 mm, 500 mm≤L2≤1500 mm.

10. The flowguide grille according to claim 9, wherein an angle between a plate surface of the drainage plate and a plate surface of the guide plate is α, which satisfies the relation: 135 degree≤α≤150 degree.

11. The flowguide grille according to claim 9, wherein the mounting bracket comprises two oppositely arranged mounting rods, the two mounting rods are mounted on the air conditioner and are arranged around the air outlet of the air conditioner;

wherein both the drainage plate and the guide plate have two opposite side surfaces, the two side surfaces of the drainage plate are respectively connected to the two mounting rods, the two side surfaces of the guide plate are respectively at least partially connected to the two mounting rods.

12. The flowguide grille according to claim 9, wherein the guide plate comprises a first plate section and a second plate section, the first plate section is connected to the drainage plate, and the first plate section is extended upward and is bent and connected with the second plate section.

13. The flowguide grille according to claim 12, wherein a shape of the first plate section is arc;

and/or, the second plate section is extended in a horizontal direction;

and/or, the guide plate and the drainage plate are in an integrated structure.

14. The flowguide grille according to claim 12, wherein a length of the second plate section of the guide plate in the high wind level component is different from a length of the second plate section of the guide plate in the low wind level component.

15. The flowguide grille according to claim 12, wherein a length of the second plate section of the guide plate in the high wind level component is greater than a length of the second plate section of the guide plate in the low wind level component.

* * * * *